United States Patent [19]

Sebastien

[11] Patent Number: 4,769,907

[45] Date of Patent: Sep. 13, 1988

[54] METHOD OF MAKING A CIRCUIT BOARD PIN

[75] Inventor: Leslie Sebastien, Cote St. Luc, Canada

[73] Assignee: Northern Telecom Limited, Montreal, Canada

[21] Appl. No.: 77,824

[22] Filed: Jul. 27, 1987

[51] Int. Cl.[4] ..... H01R 43/16; B21D 53/00

[52] U.S. Cl. ..... 29/874; 439/82; 439/825; 72/402; 72/354

[58] Field of Search ..... 29/882, 874; 439/82, 439/751, 825–827, 873; 72/354, 402, 403

[56] References Cited

U.S. PATENT DOCUMENTS

| | | | |
|---|---|---|---|
| 533,182 | 1/1895 | Stafford | 72/354 |
| 3,545,080 | 12/1970 | Evans . | |
| 4,066,326 | 1/1978 | Lovendusky | 439/873 |
| 4,533,204 | 8/1985 | Moynagh, Jr. et al. | 29/882 |
| 4,621,421 | 11/1986 | O'Loughlin | 29/874 |

FOREIGN PATENT DOCUMENTS

| | | | |
|---|---|---|---|
| 198408 | 10/1986 | European Pat. Off. | 439/82 |
| 8502163 | 6/1986 | PCT Int'l Appl. | 439/82 |

*Primary Examiner*—Daniel C. Crane
*Attorney, Agent, or Firm*—R. J. Austin

[57] ABSTRACT

A circuit board pin in which the compliant portion has two beams spaced apart on each side of a slot. The beams have outward facing surfaces which are convex in lateral cross-section. In plan view and in side elevational view the convex surfaces extend outwardly beyond parts of the pin lying next to the compliant portion and in both views also the compliant portion tapers down onto these other parts of the pin beyond ends of the slot. The compliant portion is made from a preform having two beams by applying a deforming pressure against outer lateral edges of the beams and towards the slot to deform the beams inwardly while narrowing the slot and expanding the beams outwardly in side elevation.

4 Claims, 4 Drawing Sheets

METHOD OF MAKING A CIRCUIT BOARD PIN

The invention relates to circuit board pins.

Circuit board pins are constructed for two basic methods of mounting into conductively lined pin receiving holes in printed circuit boards. In one of these methods, the pins are held within the holes by use of solder. By the other method, the pins are constructed to have compliant portions which are resiliently flexible. With these pins, the compliant portions are located in the holes, which are smaller in diameter than a critical dimension across the compliant portions, thereby resiliently moving parts of the compliant portions laterally of the pin to reduce this critical dimension and hold surfaces of the compliant portions gastightly in contact with the conductive lining of the holes.

Compliant portions of pins may be constructed according to one of many basic designs. In one of these designs sometimes referred to as the "eye of the needle", the compliant portion has two beams extending side-by-side axially of the pin and spaced apart by a slot extending through the pin. The beams merge together at each end of the compliant portion and also into other pin portions extending from the ends of the compliant portion. The "eye of the needle" design is considered ideal because is it symmetrical about the pin axis and doesn't tend to cause pin rotation as it is inserted into a hole in a printed circuit board. In addition, the beams move resiliently towards each other during pin insertion without any tendency to create pin asymmetry which would cause tilting of the pin.

However, the "eye of the needle" compliant portion has the disadvantage that it has a smaller area of contact with a conductive lining of a printed circuit board hole than does a compliant portion of some other designs. This provides for a smaller positive conductive path from the pin to the printed circuit board with the "eye of the needle" design. Also, the smaller contact area provides a smaller distribution of the load from the resilient beams into the conductive lining of the holes. This results in high localized pressure which may result in cutting into the lining thereby producing deterioration of the circuit board and a weakened conductive path.

The present invention provides a circuit board pin having an "eye of the needle" compliant portion and a method and apparatus for producing such a pin and which seeks to alleviate the above problems.

According to one aspect of the present invention there is provided a circuit board pin comprising a compliant portion extending for a part of the length of the pin, and other portions, one at each end of the compliant portion, the compliant portion comprising two resiliently flexible beams which extend along the compliant portion in spaced side-by-side relationship, one on each side of a slot extending longitudinally of the pin, the beams having oppositely outwardly facing surfaces which are convex in lateral cross-section of the beams and, in side elevational view and in plan view of the pin: (a) the convex outwardly facing surfaces extend outwardly beyond boundaries of the other portions; and (b) the compliant portion tapers down into the other portions to effect merging of the beams together and with the other portions beyond ends of the slot.

As can be seen from the circuit board pin of the invention, the outwardly facing surfaces of the beams extend not only outwardly from other portions of the pin in plan view but also extend outwardly in side elevation. As a result, these convex surfaces are wider than would be the case if they merely extended beyond other portions of the pin in plan view alone. The convex surfaces thereby provide a wider surface and hence a greater surface area for conductively contacting the lining material of a hole in a circuit board. The greater surface area for contact reduces the unit pressure on the hole surface with an attendant reduction in the chances of cutting through the lining material.

According to another aspect of the present invention there is provided a method of making a circuit board pin which has a compliant portion, the method comprising: making a preform for the compliant portion of the pin in which the preform comprises two beams which, in plan view, are spaced apart side-by-side by a slot extending axially of the preform and extend in opposite directions from the slot to outer lateral edges of the beams lying beyond the boundaries of other portions of the pin extending from each end of the preform; and completing the compliant portion by applying a beam deforming pressure against the outer lateral edges of the beams towards the slot while controlling the width of the slot thereby deforming the beams inwardly in plan view while simultaneously deforming them outwardly in opposite directions, in side elevation, beyond the boundaries of the other pin portions while deforming the outer lateral edges of the beams into convexly curved surfaces in a lateral cross-section of the beams, said surfaces extending beyond the boundaries of the other pin portions both in a plan view and side elevational view of the pin.

As can be seen from the above method of the invention, in the preform the edges of the beams extend beyond the boundaries of the other pin portions in plan view before completion of the compliant portion. During completion of the compliant portion, the beams are deformed so as to extend outwardly also beyond the boundaries of the other pin portions in the side elevational view of the pin so that the width of the convex curved surfaces is greater than would be the case without this type of deformation.

In a preferred method of making the invention, the pin is formed from a length of wire have oppositely facing surfaces which firstly provide the outer lateral edges and then the convexly curved surfaces of the beams. In this preferred method, drawn wire has substantially smooth surfaces and these smooth surfaces need to be coined or deformed solely for the purpose of forming the convexly curved surfaces and not for providing any substantial improvement of the smooth surface finish. On the other hand, it is within the scope of the invention to form the pin from sheet material by providing a pin blank which involves blanking material from either side of the blank. With such a method, however, the outer lateral edges of the beams so formed would not have the smoothness of the drawn wire and greater difficulty would be found in producing the smooth convexly curved surfaces in the completed compliant portion.

It is preferable also that in the method the wire is of rectangular cross-section. Such wire would have a width dimension bounded by a first pair of oppositely facing surfaces and a thickness dimension bounded by a second pair of oppositely facing surfaces. The width of the wire is reduced by removal of the wire material at each of the first pair of surfaces in axially spaced regions of the wire. A slot is formed in a region intermediate the axially spaced regions to form the preform in the intermediate region with the first pair of oppositely facing surfaces providing the outer lateral edges. The beam deforming pressure is then applied inwardly against the outer lateral edges of the beams to deform them outwardly in opposite directions in the direction of the thickness dimension beyond each surface of the second pair. This causes the convexly curved surfaces to extend both beyond the reduced width dimension and the thickness dimension of the two axially spaced regions.

The method also preferably includes forming the slot to a width greater than that finally required and reducing the width during the application of the beam deforming pressure to the desired slot width. With this process step, the slot of greater width is more easily blanked from the wire and the application of the beam deforming pressure enables the slot to be reduced to that desired, such as would be obtained with good manufacturing practice, e.g. the width of final slot to thickness of wire ratio of around 1:1 or even less.

The invention further provides an apparatus for making a circuit board pin including means for forming a compliant portion of the pin from a preform having two beams extending axially of the pin and, in plan view of the pin, side-by-side and spaced apart by a slot, the compliant pin forming means defining a pin location station and comprising: pressure applying elements spaced-apart in a plane across the station and oppositely acting to move towards each other to inner positions and to move apart from said inner positions in said plane, the pressure applying elements having concave opposing surfaces for forming oppositely outwardly facing surfaces on the beams, which surfaces are convex in lateral cross-section; at least one pressure resisting member which is movable normal to the plane to an inner position across the pin location station for location within the slot before movement of the pressure applying elements towards each other so as to control the width of the slot during application of pressure to the beams; the pressure resisting member and the pressure applying elements in their inner positions together defining two beam shaping cavities with the concave surfaces providing cavity defining surfaces; and holding means for holding a length of material for forming the pin in the pin location station.

One embodiment of the invention will now be described by way of example, with reference to the accompanying drawings, in which.

Figure 11:
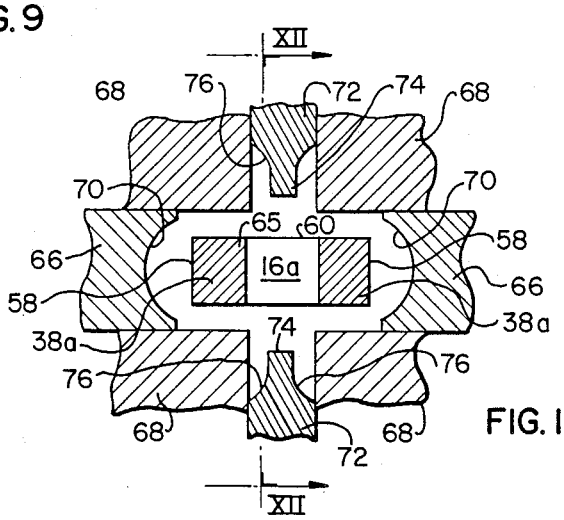
Figure 12:
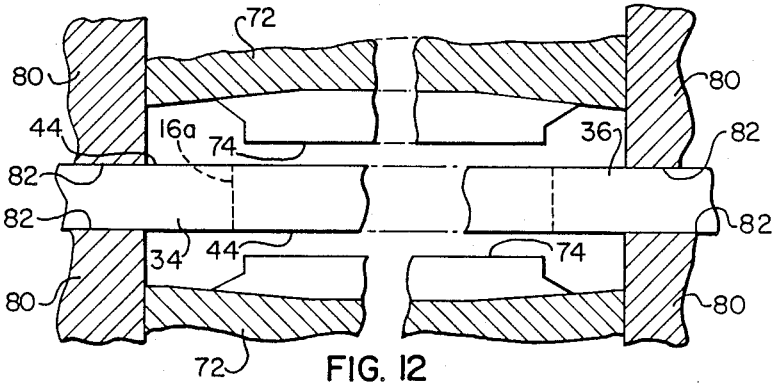
Figure 13:
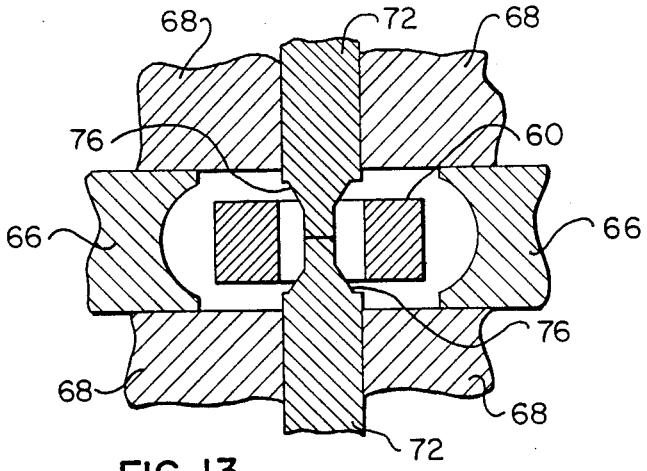
Figure 14:
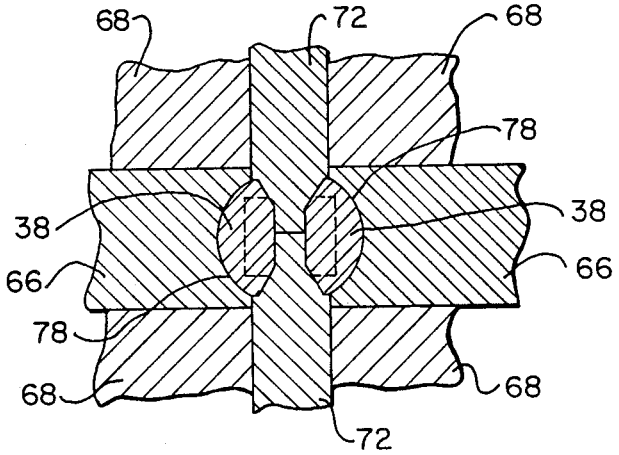

FIG. 11, to the scale of FIGS. 5 to 8, is a cross-sectional view through an apparatus for forming the completed compliant portion of the pin, showing the parts of the apparatus in an open position with a partially formed pin inserted into a location station;

FIG. 12 is a cross-sectional view through the apparatus taken along line XII—XII in FIG. 11; and FIGS. 13 and 14 are sections similar to FIG. 11 and showing different stages in the operation of the apparatus.

Figure 1:
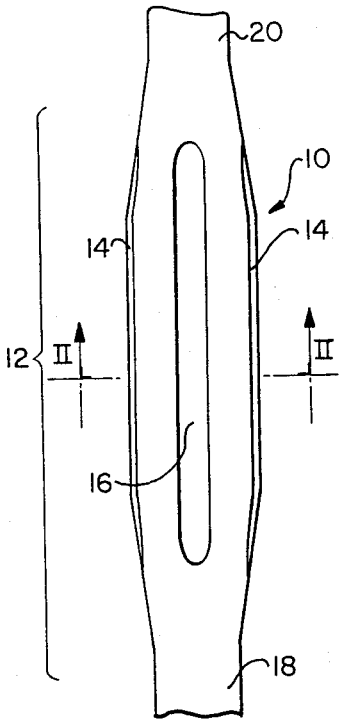
FIG. 1 PRIOR ART
FIG. 1 is a plan view of a prior art circuit board pin to a much enlarged scale.
Figure 2:
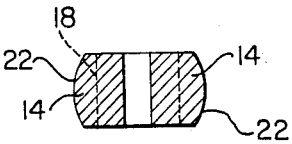
FIG. 2 PRIOR ART
FIG. 2 is a cross-sectional view taken along line II—II of the prior art pin of FIG. 1.

FIGS. 1 and 2 show a prior art circuit board pin 10 having a compliant portion 12. The compliant portion is of the "eye of the needle" design in that it has two side-by-side beams 14 extending axially of the pin, the beams being spaced apart by an axially extending slot 16. As shown by FIG. 1, in plan view, the beams extend laterally beyond other portions 18 and 20 of the pin which extend from the two ends of the compliant portion 12. As shown by FIG. 2, the pin is of constant thickness from end-to-end whereby the compliant portion, i.e. the beams 14, are no thicker than the other pin portions 18 and 20. Outer edges 2 of the two beams are convexly curved from end-to-end of the beams to provide an area of contact with lining material of a circuit board hole into which the pin is to be inserted.

Figure 3:
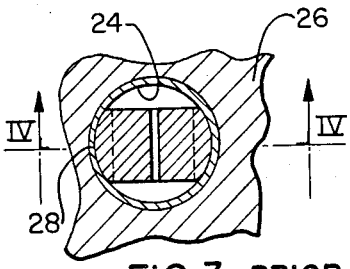
FIG. 3 PRIOR ART
FIG. 3 is a cross-sectional view through a printed circuit board showing the prior art pin of FIG. 1 assembled into the board by reception of a compliant portion of the pin within a hole of the board.
Figure 4:
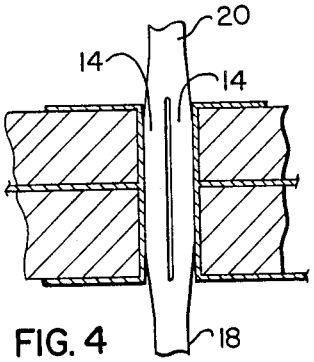
FIG. 4 PRIOR ART
FIG. 4 is a cross-sectional view taken along line IV—IV of the assembly in FIG. 3 and to a smaller scale.

The prior art pin is assembled into a pin receiving hole 24 of a printed circuit board 26, as shown in FIGS. 3 and 4. The end 18 of the pin is inserted through the hole followed by the compliant portion 12. The distance across the edges 22 is slightly greater than the diameter of the hole whereby the hole resiliently flexes the beams inward towards each other, in known manner, thereby narrowing the slot 16 so that in the final position shown in FIGS. 3 and 4, the compliant section is resiliently held within the hole with the edges 22 resiliently pressing against the inside surface of the conductive lining material 28 of the hole.

As can be seen from FIG. 3, the contact surface area between the pin and the lining material 28 of the printed circuit board is small compared to the total inner surface of the lining material. Apart from minimizing the circuit path between the pin and the lining material, the pressure applied by the small area of contact may result in cutting into the lining material to cause deterioration of the lining material and a reduction in the effectiveness of the circuit path. Further to this, in the construction of the prior art pin, the width of the slot 16 is preferably made according to good machinery practice in a ratio of approximately 1:1 in relation to the thickness of the material of the pin. However, the slot 16 needs to be blanked from the material and the blanking of a slot with such a width to material ratio may be technically difficult.

The present invention provides a circuit board pin and a method of producing such a pin which alleviates the above disadvantages. This is clear from the embodiment now to be described.

Figure 5:
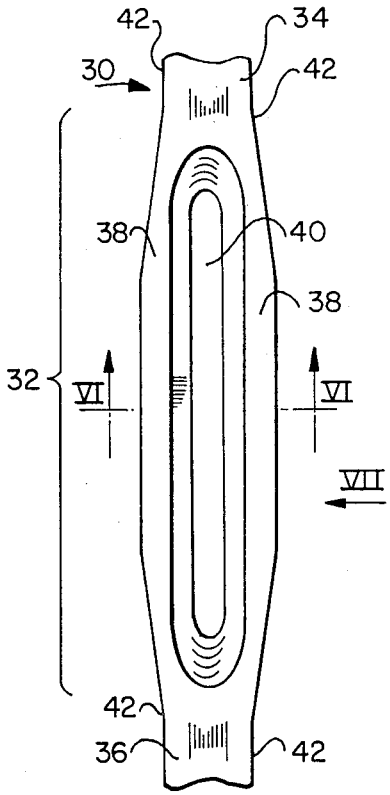
FIG. 5 is a view, similar to FIG. 1, of a circuit board pin according to the embodiment to a much enlarged scale.
Figure 8:
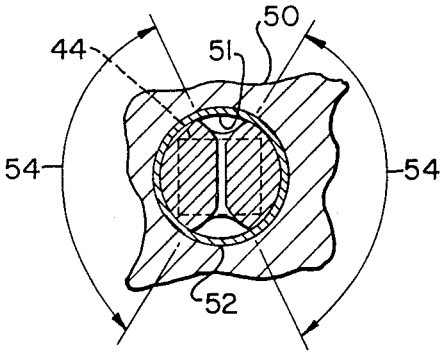
FIG. 8 is a cross-sectional view through a compliant portion of the pin of the embodiment showing the pin assembled into a hole in a circuit board.

As shown by FIG. 5, a circuit board pin 30 according to the embodiment comprises a compliant portion 32 extending axially of the pin and other portions 34 and 36 of the pin extending axially from the two ends of the compliant portion.

As in the prior art construction discussed above, the compliant portion 32 is of the "eye of the needle" type of construction and has two side-by-side beams 38 which extend axially of the pin and are spaced apart by a longitudinally extending slot 40 over the compliant portion. The portions 34 and 36 of the pin are of rectangular or square cross-section and have edge surfaces 42 (FIGS. 5 and 6) beyond which the beams 38 extend. In this respect the pin 30 is also similar to the pin 10 of the prior art.

Figure 7:
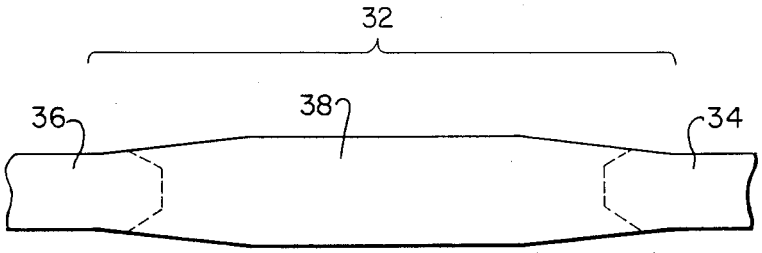
FIG. 7 is a side elevational view of the pin of the first embodiment taken in the direction of arrow VII in FIG. 5.
Figure 6:
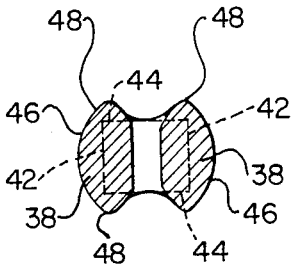
FIG. 6 is a cross-sectional view taken along line VI—VI in FIG. 5.

The pin 30 differs however from the prior art pin in the manner shown in FIGS. 6 and 7. As shown in FIGS. 6 and 7 the two beams 38 not only extend outwardly beyond the surfaces 42, but also extend outwardly beyond the other surfaces 44 of the rectangular pin portions 34 and 36. The beams 38 have oppositely outwardly facing surfaces 46 which are convex in lateral cross-section of the beams as shown in FIG. 6. These surfaces extend outwardly beyond the surfaces 42 because the beams extend beyond these surfaces as has been described. However, in addition, because the beams 38 extend outwardly beyond the surfaces 44 also, then the surfaces 46 have a lateral width (as shown in FIG. 6) which is greater than the distance between the surfaces 44. Surfaces 46 extend beyond surfaces 44 to positions 48 which approximately lie at the remote positions of the beams. In other words, the surfaces 46, both in plan view (FIG. 5) and side elevational view (FIG. 7), extend outwardly beyond the boundaries of the pin portions 34 and 36, these boundaries being the surfaces 42 and 44. Also, because of the geometry of the structure, the compliant portion tapers down into the portions 34 and 36 to effect a merging together of the beams and also into the other portions beyond the ends of the slot 40. This tapering action occurs both in the plan view of FIG. 5 and the side elevational view of FIG. 7. It will be clear that the pin 30 provides a greater surface area (i.e. surfaces 46) for electrical contact with lining material in a pin receiving hole of a circuit board, than is possible with the surface area of the prior art pin.

The pin 30 is fitted into a pin receiving hole 51 of a printed circuit board 50 (FIG. 8) in the manner of insertion described with regard to the pin 10. The pin 30 is held in position by reception of its compliant portion 32 within the layer 52 of conductive material forming the hole of the printed circuit board. With the surfaces 46 having the correct characteristic of curvature to suit the inner diameter of the insulation, it will be appreciated that a substantial arc 54 of contact occurs between each surface 46 and the conductive layer 52 and that this arc of contact far exceeds anything possible between the prior art pin 10 and the conductive lining material of its associated hole. In fact, as can be seen from FIG. 8, the arc 54 of contact between the two surfaces extends substantially beyond the surfaces 44 of the portions 34 and 36 of the pin. The larger arc of contact between the two surfaces proportionally increases the area of conductive contact between the beams and the lining material.

In addition, the substantially wide convex surfaces 46 provide a further function. As the contact area between surfaces 46 and the conductive layer 52 is substantially large compared to prior art arrangements, then there is a resultant decrease in pressure applied to the lining material by the resilient flexing of the beams 38 although the resilient outward load may be comparable to that in the prior art beams. The reduction in pressure reduces any tendency for the beams to cut into the insulation layer 52 whereby the tendency for deterioration of the printed circuit board and for reduction in the conductive path is minimized in the embodiment. It follows that in use of the circuit board pin according to the embodiment and as defined according to the invention, an improved circuit path is provided into a printed circuit board with reduced possibilities of damage resulting to the board or in a reduction in the electrical performance of the assembly.

The pin 30 is made by the method and apparatus described with reference to FIG. 9 onwards.

Figure 9:
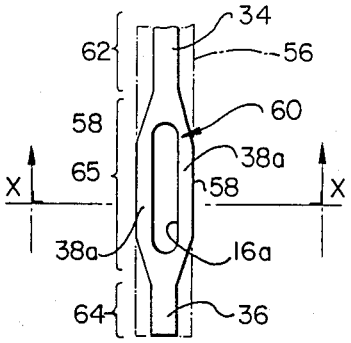
FIG. 9 is a plan view of the pin of the embodiment at one stage in its manufacture, and to a smaller scale than FIGS. 5 to 8.
Figure 10:
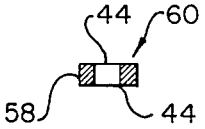
FIG. 10 is a cross-sectional view through the partially completed pin taken along line X—X in FIG. 9.

The pin 30 is formed as one of a succession of pins from a rectangular cross-section wire 56 shown chain-dotted in FIG. 9. The wire is drawn wire having substantially perfectly smooth side edges 58 across a width dimension of the wire, and top and bottom surfaces 44 across a thickness dimension of the wire, (FIG. 10), the surfaces 44 corresponding to the surfaces 44 of a finished pin.

A pin preform 60 is formed at the leading end of the wire and is removed from the wire before formation of a subsequent pin preform. Each pin preform is provided, in a conventional manner for forming pin preforms from drawn wire, by reducing the width of the wire in two axially spaced regions 62 and 64 which are separated by an intermediate region 65 which is to become a preform for the compliant portion. The width of the wire is reduced by removal of the wire material from each surface 57 in a symmetrical fashion whereby the final cross-sectional shape and size of the pin portions 34 and 36 are produced upon the pin preform. The intermediate region 65 progressively tapers into the pin regions 34 and 36 as shown by FIG. 9. In addition, a slot **16*a* is provided extending longitudinally of the intermediate region 65, and this defines two rectangularly shaped beams 38*a* having outer lateral edges 58. The ratio of the width of the slot 16*a* to the thickness of the wire, i.e. between surfaces 44**, is substantially greater than 1:1 as this width of slot is easier to blank out.

The wire is then fed forwardly to locate the pin preform 60 in a pin location station within apparatus which includes means for forming the completed compliant portion of the pin. As shown by FIGS. 11 and 12, the intermediate region 65 is located between two pressure applying elements 66 which are movable towards each other and apart horizontally, between guides 68, towards and away from the pin location station. The elements 66 have concave opposing surfaces 70 for forming the oppositely outwardly facing convex surfaces 46 on the beams. In addition, the apparatus includes two pressure resisting members 72 which are movable towards each other and apart in a vertical plane and partly across the pin location station. As can be seen from FIG. 11, the two pressure resisting members 72 are also guided between the guides 68 and have reduced width ends 74 for location within the hole **16*a* as will be described. The reduced ends merge into greater width parts of the members 72 by inclined surfaces 76. The elements 66 and members 72 are movable between positions apart shown in FIG. 11 and inner or positions closer together as shown in FIGS. 13 and 14. In the inner positions shown in FIG. 14, the concave surfaces 70 and the side and inclined surfaces of ends 74 of members 72 define two cavities 78 for shaping the beams 38 and for producing the taper into pin portions 34 and 36. In addition, the apparatus is provided with means for holding the length of material, i.e. the drawn wire, during deformation of the preform 60 to make the compliant portion. In this embodiment, the holding means comprises vertically movable clamping members 80, which are moved to inner clamping positions (as shown in FIG. 12) before movement of members 72 into their inner positions. These clamping members 80 have clamping surfaces 82 for engagement with the surfaces 44 of the pin portions 34 and 36**.

In use of the apparatus shown in FIG. 11 onwards, the pin blank 60 is located in its pin location station with the intermediate region 65 disposed between the outwardly positioned elements 66 and members 72. The clamping members 80 and the pressure resisting members 72 are then moved to their inner positions in which the clamping members clamp against the surfaces 44 of the pin regions 34 and 36 and the members 72 enter into the slot **16*a* until they abut each other as shown by FIG. 13. In this position, the inclined surfaces 76 of the members 72 also lie partly within the slots 16*a*. The elements 66 are then moved inwardly from the position in FIG. 13 to that of FIG. 14. During this movement the surfaces 70 engage the outer lateral edges 58 of the beams 38*a* and progressively coin them so as to provide the convex surfaces 46 and also to displace the material in the beams 38*a* laterally into parts of the cavity 78. In this way, the material in the beams 38*a* becomes displaced beyond the surfaces 44, as shown in the finished structure of FIG. 6. Hence the surfaces 46 are formed with their lateral width greater than the original thickness of the wire itself. During the deformation process also, the material of the beams 38*a* is displaced inwardly against the reduced ends 74 of the members 72 so as to reduce the width of the slot 16*a*** to a desired width to thickness of material ratio, e.g. around 1:1. This ratio has thus been produced while avoiding the usual difficult blanking operation to produce such a ratio of slot width to material thickness.

As the starting material for the pin was drawn wire then the edges 58 were particularly smooth at the beginning of the coining operation so that coining is only required to reshape the surfaces to form the surfaces 46 and operations are not required substantially to enhance smoothness of the surface. The coining operation merely retains the smoothness of the surface during deformation. In addition, the coining operation provides some lateral grain flow in the material of the beams thereby increasing their strength beyond that provided by the grain flow extending axially of the pin and inherent from the drawn wire.

After the compliant portion of the pin has been formed, the pin together with other pins may be assembled in spaced side-by-side relationship, i.e. in the form of a conventional "bandolier", for any further operations upon the pins to finish the end portions 34 and 36.

What is claimed is:

1. A method of making a circuit board pin having a compliant portion between two end portions comprising:

providing a length of non-tubular material for the pin;

making a preform for the compliant portion of the pin by forming a slot through the length of material, the slot extending longitudinally of the length and spaced from ends of the length to provide an end portion of the pin at each end of the slot and two beams of the compliant portion, the beams extending outwardly from each side of the slot beyond the end portions along the complete length of each beam;

applying a beam deforming pressure against outer lateral edges of the beams to urge the beams inwardly towards each other to decrease the width across the beams and to narrow the slot until the beams engage a pressure resisting surface disposed within the slot; and completing the compliant portion by continuing to apply the beam deforming pressure inwardly towards the slot:

(a) to compress the beams against the pressure resisting surface and reduce the lateral width of each beam while simultaneously expanding the beams outwardly at each side in directions parallel to the depth direction of the slot wherein the depth direction is from one opening of the slot to the other; and (b) to deform the outer lateral edges of the beams into convexly curved shapes when considered at any cross-section along the beams normal to the longitudinal direction of the pin, said convexly curved lateral edge of each beam, at any such cross-section, lying outwardly beyond boundaries of the end portions both in directions normal to and directions parallel to the depth direction of the slot.

2. A method according to claim 1 comprising making the pin from a length of drawn wire having oppositely facing surfaces and forming the beams with the oppositely facing surfaces providing the outer lateral edges of the beams, and then deforming the edges of the beams into the convexly curved surfaces.

3. A method according to claim 1 comprising making the pin from a length of wire of rectangular cross-section having a width bounded by a first pair of oppositely facing surfaces and a thickness bounded by a second pair of oppositely facing surfaces;

reducing the width of the wire by removal of wire material at each of the first pair of surfaces in two axially spaced regions to form the two end portions at said regions, and forming the slot in a region intermediate the other pin portions to provide the preform in the intermediate region with the first pair of oppositely facing surfaces providing the outer lateral edges of the beams; and applying the beam deforming pressure against the outer lateral edges of the beams to deform the beams outwardly, in opposite directions, in the direction of the thickness dimension beyond each surface of the second pair to cause the convexly curved surfaces to extend beyond the thickness dimension as well as beyond the width dimension of the other pin portions.

4. A method according to claim 1 comprising causing a divergence of the sides of the slot as the sides extend outwardly towards openings to the slot, and merging the divergent sides with the convexly curved lateral edges of the beams.

* * * * *